US009187904B2

(12) United States Patent
Stanton

(10) Patent No.: US 9,187,904 B2
(45) Date of Patent: Nov. 17, 2015

(54) PROTECTIVE ENCLOSURE FOR A WELLHEAD

(71) Applicant: Robert J. Stanton, Weatherford, TX (US)

(72) Inventor: Robert J. Stanton, Weatherford, TX (US)

( * ) Notice: Subject to any disclaimer, the term of this patent is extended or adjusted under 35 U.S.C. 154(b) by 0 days.

(21) Appl. No.: 14/557,129

(22) Filed: Dec. 1, 2014

(65) Prior Publication Data

US 2015/0082713 A1 Mar. 26, 2015

Related U.S. Application Data

(63) Continuation-in-part of application No. 13/893,775, filed on May 14, 2013, now abandoned, which is a continuation-in-part of application No. 13/214,380, filed on Aug. 22, 2011, now abandoned.

(51) Int. Cl.

| | |
|---|---|
| ***E04H 1/00*** | (2006.01) |
| ***E04D 11/00*** | (2006.01) |
| ***E04B 7/00*** | (2006.01) |
| ***E04C 3/32*** | (2006.01) |
| ***E05B 17/20*** | (2006.01) |
| ***E05B 63/18*** | (2006.01) |
| ***E05C 3/04*** | (2006.01) |
| ***E21B 41/00*** | (2006.01) |
| *E05B 13/00* | (2006.01) |

(52) U.S. Cl.

CPC . *E04D 11/00* (2013.01); *E04B 7/00* (2013.01); *E04C 3/32* (2013.01); *E05B 17/2034* (2013.01); *E05B 63/18* (2013.01); *E05C 3/045* (2013.01); *E21B 41/0021* (2013.01); *E05B 13/002* (2013.01)

(58) Field of Classification Search

CPC ..... E03B 7/095; E03B 9/10; E04H 9/10; E04H 1/1238; E21B 33/037; E21B 33/03; E21B 41/0021; F16L 57/00; F16L 59/161; E02D 29/127; E02D 29/14; E06B 11/00; F16K 35/00; Y10S 52/12; E04D 11/00; E05B 17/2034; E05B 63/18; E05B 13/002; E05C 3/045; E04B 7/00; E04C 3/32

USPC ..... 52/198, 91.1, 91.3, 79.1, 19, 70, 106, 52/107, 125.2; 89/36.04; 137/363, 364, 137/372, 377, 382

See application file for complete search history.

(56) References Cited

U.S. PATENT DOCUMENTS

| | | | | |
|---|---|---|---|---|
| 3,871,137 | A * | 3/1975 | Grammatico | 451/340 |
| 2007/0107339 | A1 * | 5/2007 | Matsumoto | 52/295 |
| 2010/0088974 | A1 * | 4/2010 | Scott, IV | 52/79.5 |

FOREIGN PATENT DOCUMENTS

| | | | | |
|---|---|---|---|---|
| GB | 2092636 | A * | 8/1982 | E04B 1/343 |

*Primary Examiner* — Syed A Islam
*Assistant Examiner* — Omar Hijaz
(74) *Attorney, Agent, or Firm* — Charles D. Gunter, Jr.

(57) ABSTRACT

A protective enclosure for protecting well head equipment at a surface location is made up of an open framework of structural members which surround and protect the well head. Individual steel panels are assembled to form a series of upstanding walls which are covered by a series of roof panels and which together define the quasi-enclosed area surrounding the well head. The roof panels are covered with a steel grating which forms a covered roof for the protective enclosure. The tubing which makes up the steel panels is spaced to allow access to the enclosed area by a worker needing to access the well head. Upright legs of the steel panels are joined together by hinged brackets. The panels can also be secured to the surrounding terrain by a cemented retainer arrangement.

2 Claims, 9 Drawing Sheets

PROTECTIVE ENCLOSURE FOR A WELLHEAD

CROSS REFERENCE TO RELATED APPLICATIONS

The present application is a continuation-in-part of earlier filed Ser. No. 13/893,775, filed May 14, 2013, which, in turn, was a continuation-in-part of earlier filed Ser. No. 13/214,380, filed Aug. 22, 2011, entitled "Protective Enclosure For A Wellhead", by the same inventor, now abandoned.

BACKGROUND OF THE INVENTION

1. Field of the Invention

The present invention relates generally to a system and apparatus for protecting equipment associated with oil and gas producing wells and, more specifically, for protecting exposed well head equipment such as Christmas trees, valves and accessory equipment located at the well surface.

2. Description of the Prior Art

The nature of the ordinary well head is such that it embodies sufficient control means that the well can be adjusted to safely produce at a desired rate. Depending on the type of formation being produced and other factors, the well head itself can assume different proportions and embody varying forms of equipment adapted to the particular conditions at hand. It is customary in the oil and gas industry to refer to the upper most portion of the well head as it leaves the surface of the ground as the "Christmas tree." The Christmas tree is generally an assembly of valves, tees, crosses, and other fittings at the well head used to control oil or gas production and to give access to the well tubing. Other fittings such as choke jackets, pressure gauges, and the like, can become part of what is known in the art as the "Christmas tree." Many times, a master valve is provided on the Christmas tree which controls the flow of gas or oil directly from the well itself. This valve can be closed, preventing any flow from the well to the Christmas tree itself.

Other valuable devices, such as additional expensive valves, may also be present at the well head. Many times, a very expensive control valve may be mounted on a pipeline itself. These valves and controllers are quite expensive, and their damage likewise brings a loss of production or supply of oil or gas flowing with the pipeline. While this assembly of valves, tees and other fittings which is affixed to the gas well or oil well at the well head is fairly sturdy in construction, it is possible for it to become damaged in a number of different situations.

One way in which damage can occur is due to the nature of the proximity of plural wells being completed within feet of each other. Often, where a highly productive oil or gas reserve field is discovered, a number of wells will be drilled into the area, each being furnished with a well head which protrudes just above the ground. Often in a highly productive area, these well heads are closely spaced. This situation creates particular concern where a new well is being completed in close proximity to an already completed well head or well heads. It is always possible that equipment can be dropped on the existing well head/heads, for example, by a crane being used to move a new Christmas tree into position at the site. The undesirable consequence of such damage could be an uncontrolled flow of the crude oil or gas. There have been instances, for example, where well heads have been damaged to the point of requiring replacement of one or more of the component parts.

Various schemes have been proposed for protecting both surface well head equipment and also sub-sea well head equipment. However, the prior art proposals have generally been lacking in one or more respects. For example, certain of the prior art constructions were permanent in nature and were not easily removed or transported from one well site to another.

A further feature of a suitable well head protective enclosure for the present purposes is that it must accommodate workover tools and instruments which are periodically inserted into the well for various reasons. It is also obviously necessary for worker personnel to be able to access the well head components to perform these and other customary operations. The protective enclosure must not impede these necessary operations.

It has therefore become a desirable to provide some form of protective enclosure for a well head of the type under consideration, especially where several well heads are located in close proximity. Preferably, the protective structure would be designed to deflect or deter damaging contact between a well head and heavy moving objects or lines. A primary function of the protective enclosure would be to permit the well head to operate in a safe manner and yet be readily accessible for workover purposes and/or for inspection, routine maintenance, or other such purposes. The enclosure would also preferably be assembled from a number of component parts which could be disassembled and transported to another location, when desired, with a minimum of effort being required for the disassembly.

Thus, despite the advances which have been made in well head construction, there continues to exist a need for an improved well head enclosure which would meet the previously expressed needs.

SUMMARY OF THE INVENTION

In order to address the foregoing needs, there is presently provided a well head protector which is sufficiently sturdy to perform its designed function, and yet can be readily transported to and installed at a remote well head location. The protector is thus initially fabricated into discrete sub-assemblies which can be easily transported to a desired well location, as by truck. After use, the protective enclosure can be broken down into its respective component parts and transported to another location and reassembled.

The preferred protective enclosure is comprised of an open framework of structural members which define a quasi-enclosed area adapted to surround and protect the well head. The open framework of structural members is made up of a plurality of individual steel panels, each of the steel panels being constructed of lengths of square steel tubing, the panels being assembled to form a series of upstanding walls which are covered by a series of roof panels and which together define the quasi-enclosed area surrounding the well head. The series of roof panels are, in turn, covered with a steel grating which forms a covered roof for the protective enclosure. The lengths of square steel tubing which make up the steel panels are spaced a selected distance apart which allows access to the quasi-enclosed area by a worker needing to access the well head.

In some instances, the individual steel panels which make up the protective enclosure are joined together using a plurality of lever latch and keeper assemblies. Each of the lever latches is rotatably mounted on one of the lengths of square steel tubing making up one of the steel panels, the associated keeper assembly including a lock element. The lever latch and keeper assemblies are movable between a locked position which temporarily locks the steel panels together and an unlocked position which allows the protective enclosure to be disassembled for transportation to a different location.

In one form of the invention, the series of roof panels are connected to the steel grating which forms the covered roof for the protective enclosure by a plurality of removable U-bolts. The steel grating can conveniently be provided with a series of upstanding ring members which allow the steel grating to be lifted into position on the roof panels or to be removed, if necessary, to provide additional access for maintenance or other operations.

In one version of the invention, at least selected ones of the lengths of square steel tubing making up the upstanding walls of the enclosure are provided with a telescoping leg which can be moved between a retracted position inside the respective length of steel tubing, and an extended position which provides an exposed length of tubing which can be cemented into the ground at the well location. The telescoping leg includes at least one locking hole for receiving a locking member. In the most preferred form, there are at least two locking holes provided in each telescoping leg, the holes being spaced to allow the telescoping leg to be locked in either the extended or retracted position. The telescoping leg and associated length of steel tubing can also be provided with aligned holes which receive a locking pin when the telescoping leg is in the extended position to further secure the telescoping leg.

The lever latch assemblies, telescoping legs and removable roof grating allow the entire enclosure to be disassembled by retracting the telescoping legs and unlocking the lever latch and keeper assemblies, whereby the enclosure can be easily disassembled and moved to another well location.

In another version of the invention, at least selected ones of the lengths of square tubing making up the panel upright legs of the enclosure are provided with a special cemented retaining arrangement with U-bolts being used to join individual upright legs of the panels, rather than using the telescoping legs.

In a final version of the invention, the U-bolts used to join the individual upright legs of the panels are replaced with specially designed hinged brackets which provide added ease of installation as well as additional structural integrity to the assembly.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
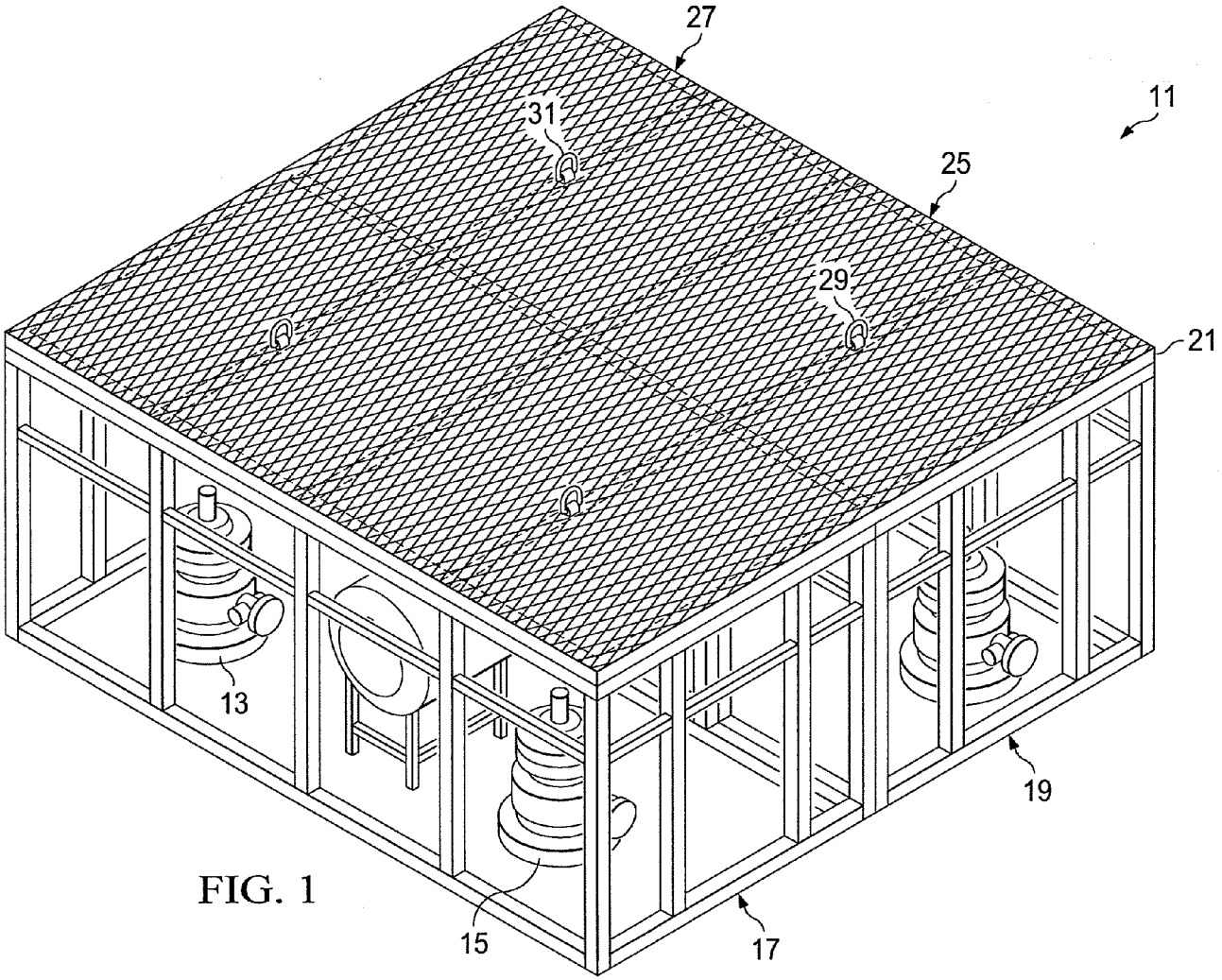
FIG. 1 is a perspective view of one version of the protective wellhead enclosure of the invention showing the assembled steel panels and roof grating in place on the well head equipment.

FIG. 1 is a perspective view of one version of the protective enclosure of the invention, designated generally as 11. The enclosure 11 is used to enclose a number of different closely spaced well head component assemblies, such as assemblies 13, 15. As has been discussed, such assemblies will typically involve an oil or gas well Christmas tree. Such Christmas trees are well known in the relevant arts and will not be described in detail other than to say that they are made up of an assembly of valves, tees, crosses, and other fittings at the well head, used to control oil or gas production and to give access to the well tubing.

As will be appreciated from FIG. 1, the protective enclosure 11 encloses the well heads 13, 15, at the surface location above ground in order to preclude encounter between the well head and objects which might be brought into damaging contact therewith. The protective enclosure 11 is made up of an open framework of structural members which define a quasi-enclosed area adapted to surround and protect the plurality of well heads. The open framework of structural members is itself comprised of a plurality of individual steel panels, such as panels 17, 19. Each of the steel panels 17, 19, is preferably constructed of polygonal lengths of metal tubing, such as the lengths of square steel tubing shown in the drawings. The lengths of square steel tubing which make up the steel panels are spaced a selected distance apart which allows access to the quasi-enclosed area by a worker needing to access the well head equipment.

The panels 17, 19 are assembled to form a series of upstanding walls which are covered by a series of roof panels (such as the panel 21 in FIG. 1 and the portion of the panel 23 in FIG. 3) and which together define the quasi-enclosed area surrounding the well head. The series of roof panels are, in turn, covered with a steel grating which forms a covered roof for the protective enclosure. The steel grating can be provided in, for example, square or rectangular sections, such as sections 25, 27 shown in FIG. 1. The steel grating is preferably provided with some sort of attachment elements to facilitate moving and placing the grating on top of the assembly, as by a crane. In the example illustrated in FIG. 1, the grating is provided with a series of upstanding ring members 29, 31, which allow the steel grating to be lifted into position on the roof panels.

Figure 3:
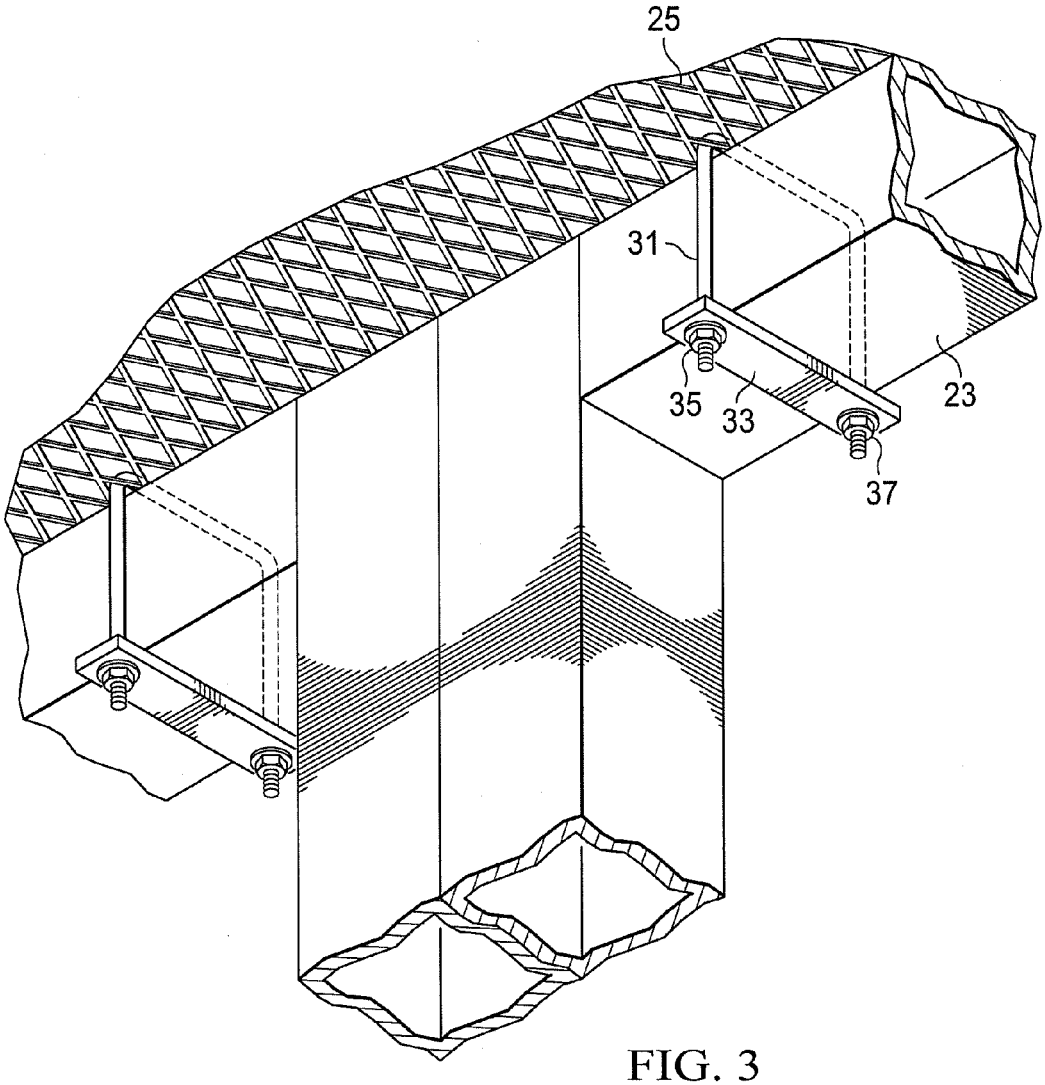
FIG. 3 is an isolated view of a section of the steel roof grating, the grating being shown attached to the associated steel structural panels by a pair of U-bolts.

As best seen in FIG. 3, the series of roof panels (such as panel 23) are connected to the steel grating 25 which forms the covered roof for the protective enclosure by a plurality of removable U-bolts 31. The U-bolts pass up, over and around the openings in the grating and are secured in place by means of a cross plate 33 and end nuts 35, 37. This arrangement makes the steel grating easily removable and does not require more extensive installation operations, such as welding.

Figure 2A:
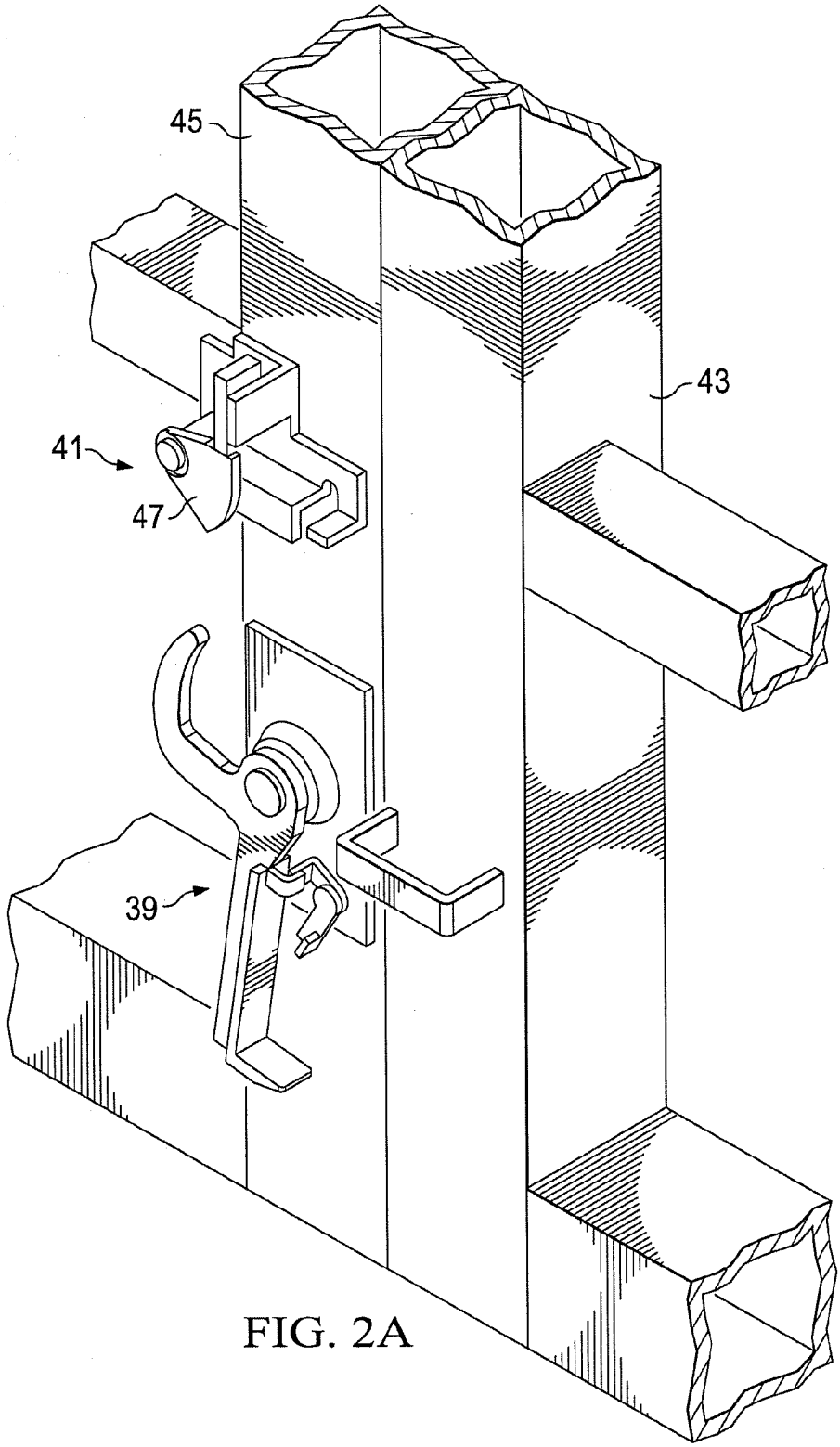
FIG. 2A is an isolated view of one of the lengths of square steel tubing which makes up one of the structural panels of the enclosure, the associated lever latch and keeper assembly which is used to connect adjacent panels being shown in the unlocked position.
Figure 2B:
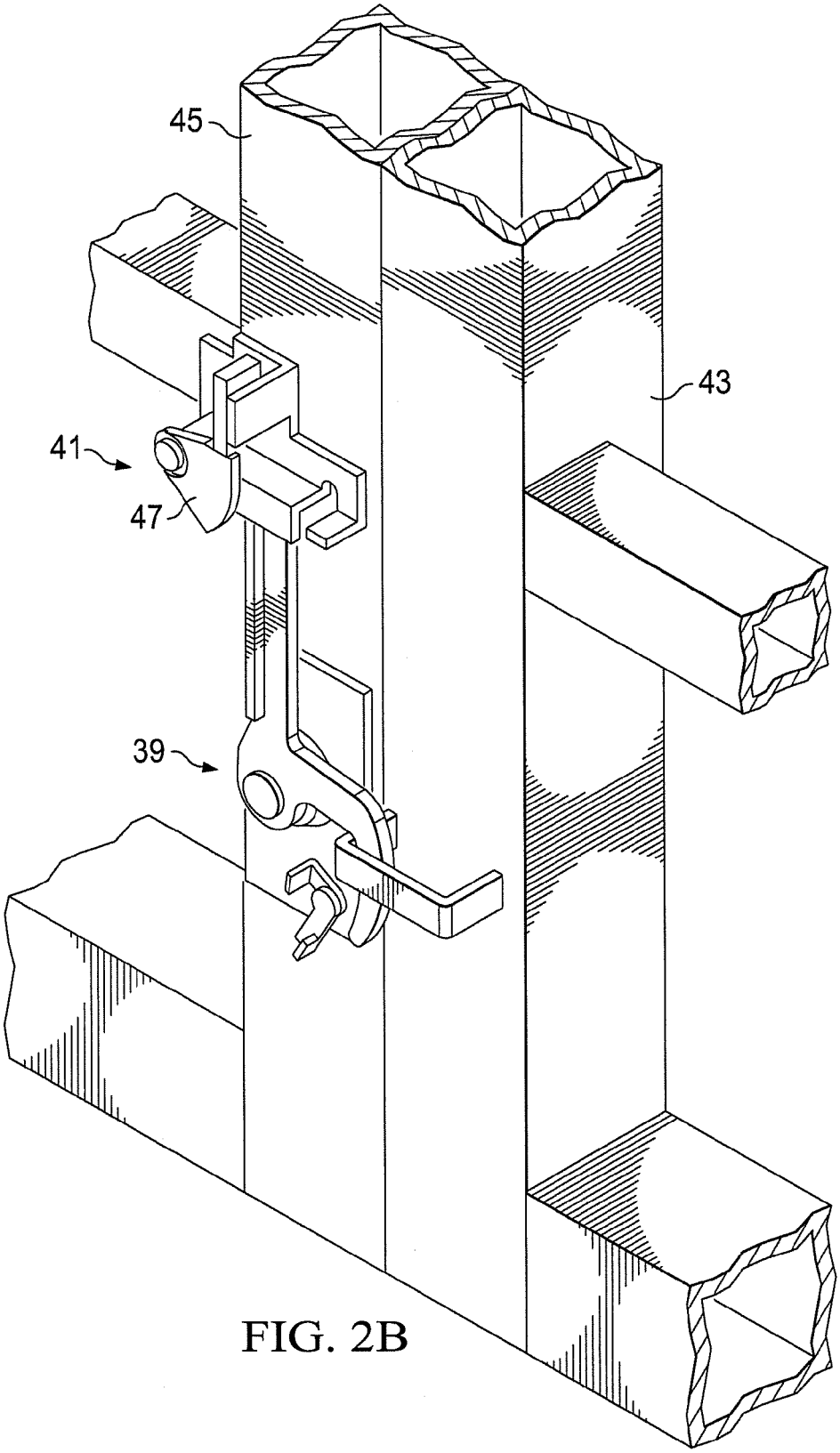
FIG. 2B is a view similar to FIG. 2A, but showing the lever latch and keeper assembly in the locked position.

As shown in FIGS. 2A and 2B, the individual steel panels which make up the protective enclosure are, in this instance, joined together using a plurality of lever latch and keeper assemblies, 39, 41, respectively. In FIG. 3, two panel uprights 43, 45, are joined by the lever latch 39 and keeper assembly 41. FIG. 2A shows the lever latch and keeper assembly in the open or unlocked position, while FIG. 2B shows these members in the closed and locked position. Each lever latch 39 is rotatably mounted on one of the lengths of square steel tubing making up one of the steel panels uprights, such as upright 45. The associated keeper assembly 41 also preferably includes a lock element 47. It is necessary to rotate the lock element 47 in order to release the lever latch from the closed and locked position shown in FIG. 2B. The lever latch and keeper assemblies can thus be seen to be movable between a locked position which temporarily locks the steel panel together and an unlocked position which allows the protective enclosure to be disassembled for transportation to a different location.

Figure 4:
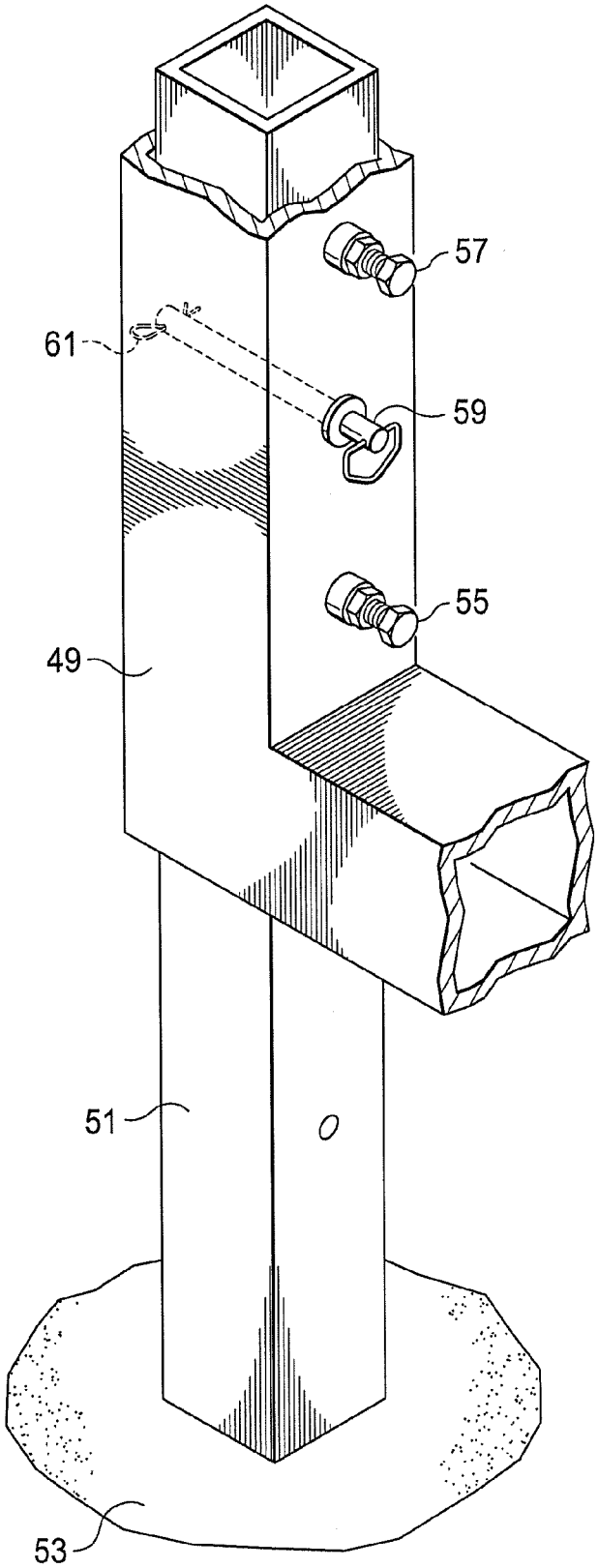
FIG. 4 is an isolated view of the lower portion of one of the structural panels, showing the telescoping leg extending from the panel and the lock members used to retain the telescoping leg in the extended position in one version of the invention.

While the protective enclosure 11 could be assembled using the lever latch and keeper assemblies and merely set up on the well site, it is often desirable to further secure the enclosure to the ground. This can be accomplished, as shown in FIG. 4, by providing at least selected ones of the lengths of square steel tubing (such as the leg or end wall 49) making up the upstanding walls of the enclosure with a telescoping leg 51. The telescoping leg 51 can be moved between a retracted position inside the respective length of steel tubing, and an extended position (shown in FIG. 4) which provides an exposed length of tubing which can be cemented into the ground at the well location. When it is desired to move the enclosure, the telescoping leg 51 can be dug up and the cement block 53 knocked off.

Preferably, the telescoping leg 51 includes at least one locking hole 53 for receiving a locking member, such as members 55, 57. The locking members 55, 57, illustrated in FIG. 4 are threaded bolts which can be tightened in order to secure the telescoping leg in the desired position, either extended or retracted. As an added safety measure, the telescoping leg and associated length of steel tubing can be provided with aligned holes which receive a locking pin 59 when the telescoping leg is in the extended position to further secure the telescoping leg. In the example illustrated in FIG. 4, the locking pin 59 traverses both the telescoping leg 51 and the upright member 49 and is held in place by a cotter pin 61.

Figure 5:
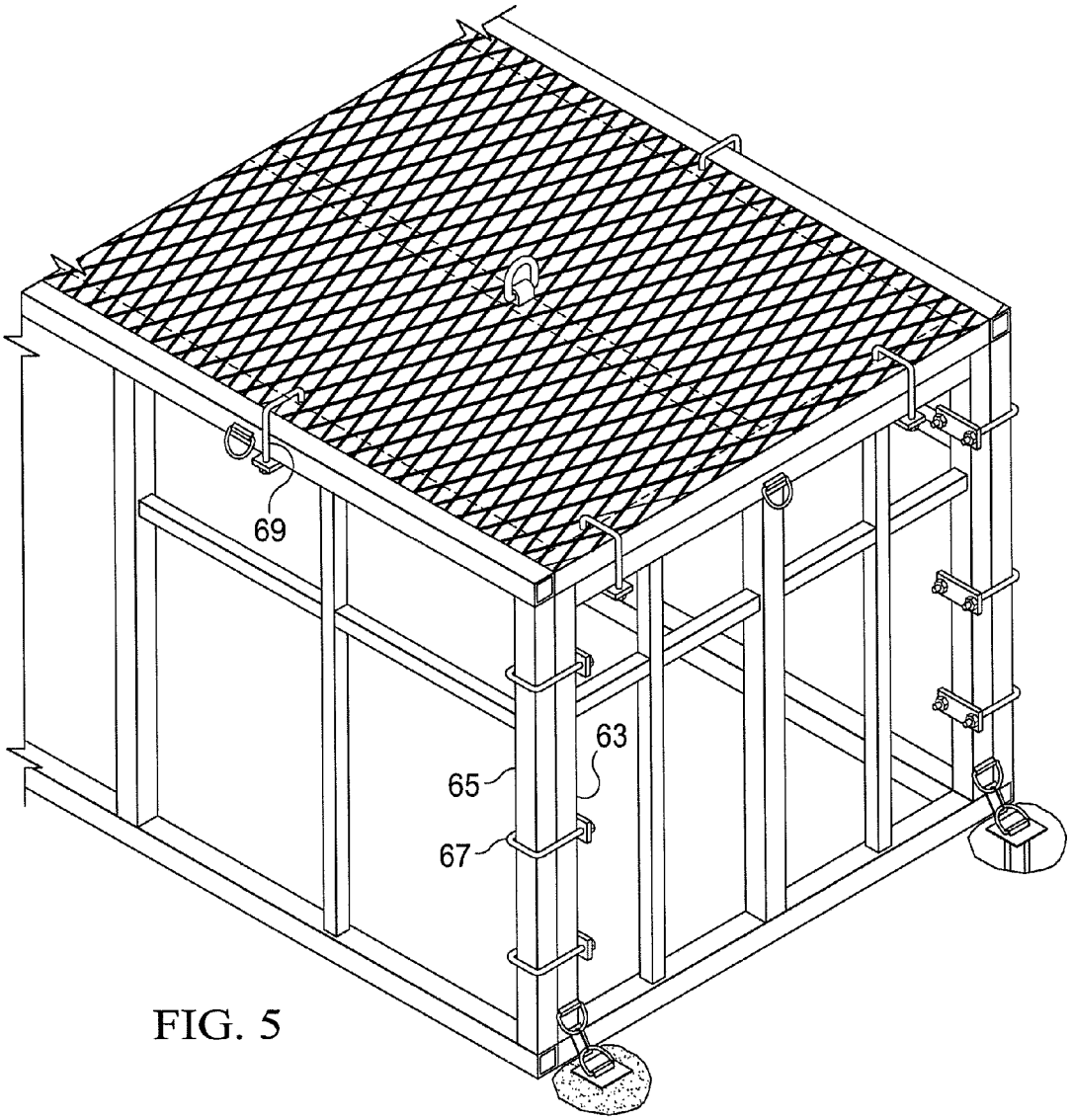
FIG. 5 is a partial perspective view of another version of the protective enclosure of the invention showing U-bolts being used to join the individual panels of the enclosure and showing a cemented retaining arrangement which is used instead of the telescoping legs.
Figure 6:
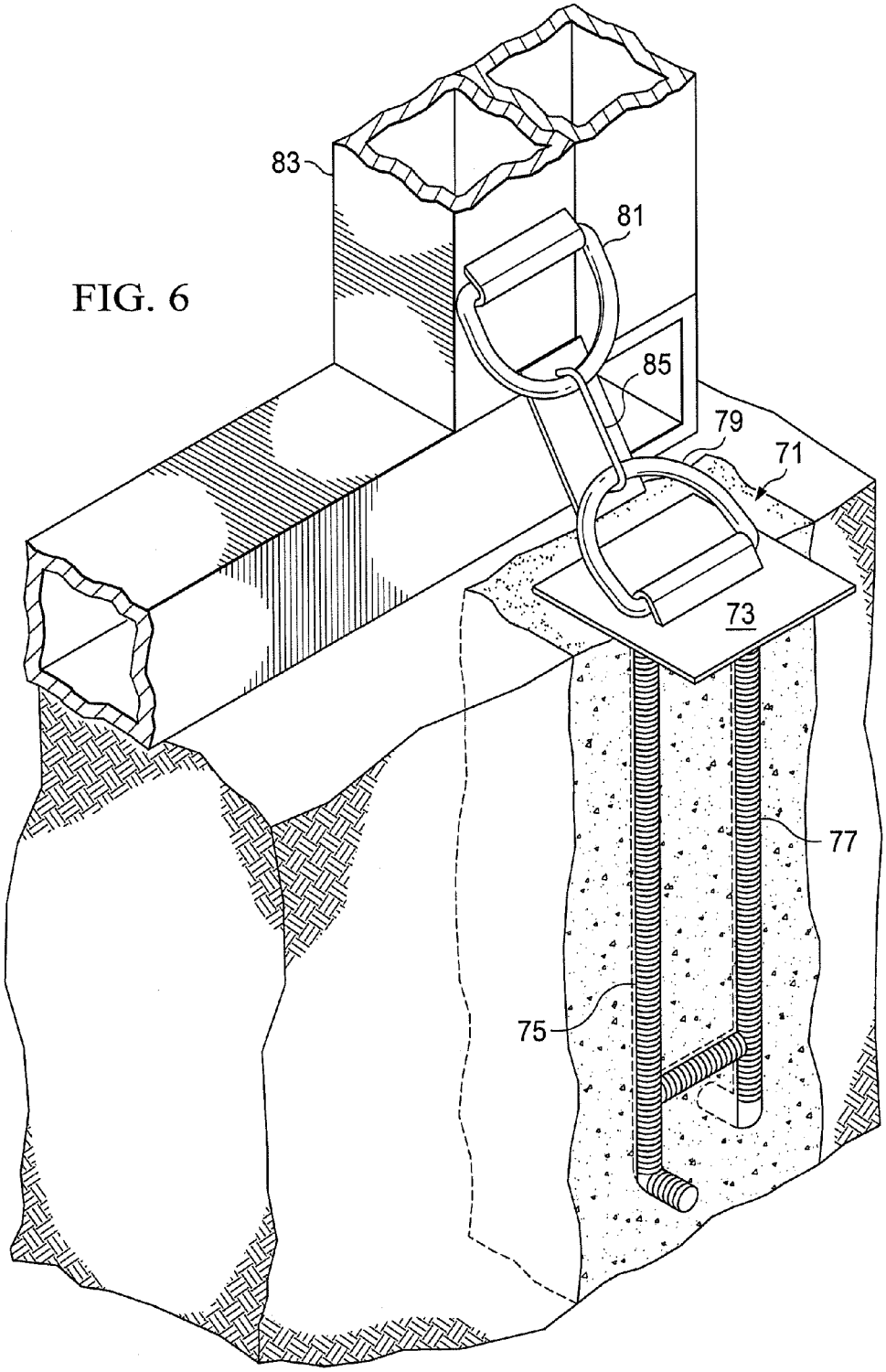
FIG. 6 is a close up view of the cemented retaining arrangement of FIG. 5.

FIGS. 5 and 6 show another version of the protective wellhead enclosure of the invention. In the version of the enclosure shown in FIG. 5, the individual panels making up the enclosure are joined together by one of more U-bolts 67, such as the U-bolts 69 used to affix the roof grating to the assembly. The version of the invention shown in FIGS. 5 and 6 also uses a different type of cemented retaining arrangement to ensure that the enclosure is firmly fixed in position, while at the same time allowing the enclosure to be easily moved to an alternate location when desired.

FIG. 6 shows the alternative cemented retaining arrangement in close up fashion for ease of illustration. The retaining arrangement (designated generally as 71) includes a retainer plate 73 which is buried in the earth, along with it's downwardly extending legs 75, 77. The plate 73 is a generally planar member arranged generally parallel to the earth surface in which it is buried with the legs extending downwardly therefrom. The legs in the example shown are made of rebar steel reinforcing material which is welded to the bottom surface of the plate 73. The opposing top surface of the plate 73 has an upstanding ring member 79 which is joined to a similar ring member 81 on the panel upright leg 83 by any convenient connector. The type of connector is not particularly critical and can assume a variety of forms. For instance, the connection between the two rings 79, 81 could comprise a hose clamp or pipe clamp, a chain fitting, a hoist ring, a metal hook, a turnbuckle or even a padlock. In the example shown in FIG. 6, the connector is a U-bolt 85. When it becomes necessary to take down or move the enclosure, the U-bolt 85 is simply removed, freeing the panel of the enclosure and leaving the retaining plate 73 and it's component parts behind. These can simply be covered with dirt for esthetic purposes.

Figure 7:
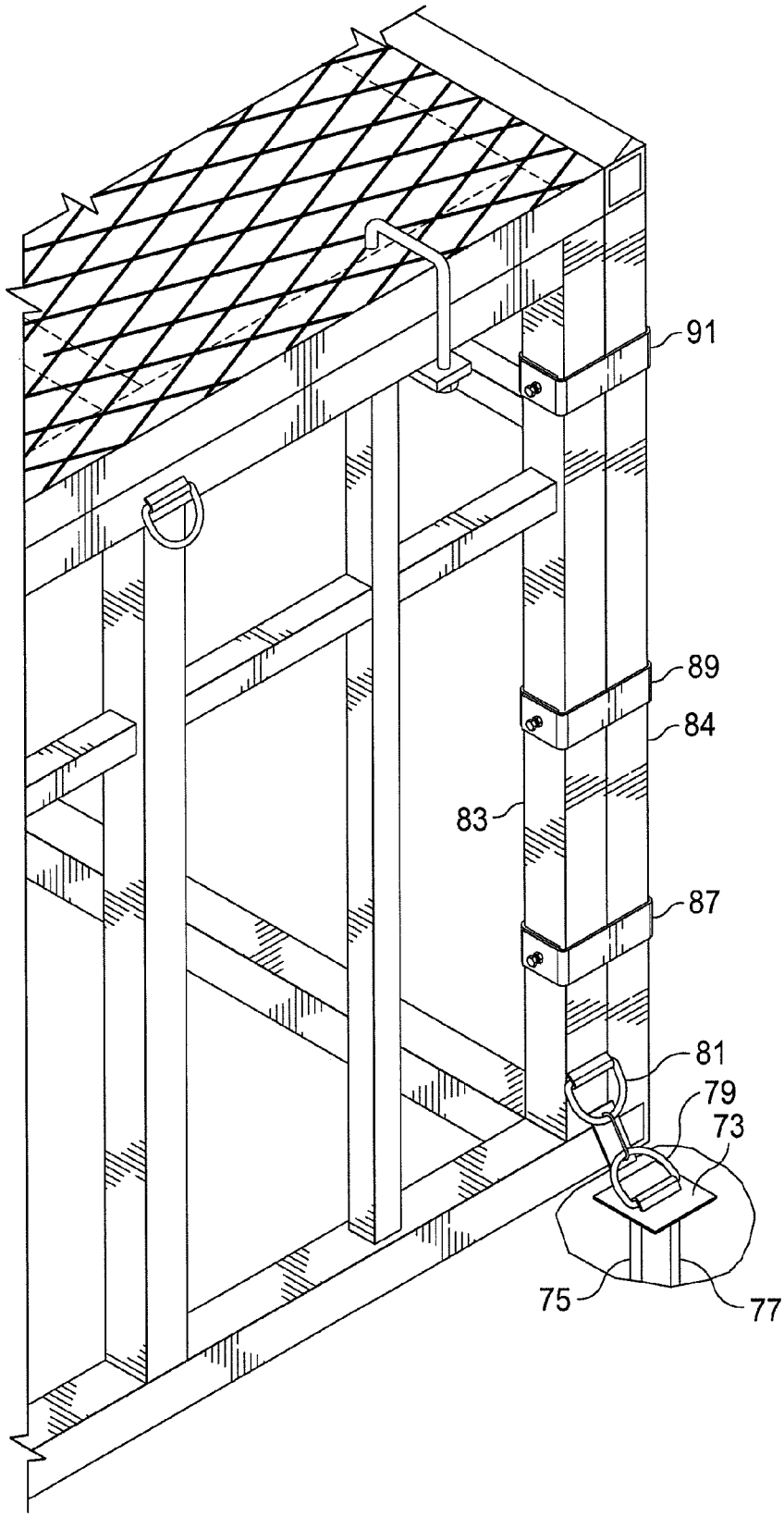
FIG. 7 is a partial perspective view which shows another version of the invention in which the U-bolts used to join the upright panels are replaced with specially designed hinged brackets.

FIG. 7 shows another version of the invention in which at least selected ones of the upright legs 83, 84 of square tubing making up the upstanding walls of the enclosure are provided with specially designed hinged brackets 87, 89, 91 which provide added ease of installation as well as additional structural integrity to the assembly. The special hinged brackets replace the U-bolts (67 in FIG. 5) which were used in that assembly to join the individual upright panels. In some situations, as in extremely cold weather, or in muddy and greasy conditions it was hard for installers to thread the nuts onto the ends of the U-bolts. The newly designed hinged brackets provide an easier and more reliable connector for joining the panels, even in cold or dirty conditions.

Figure 8:
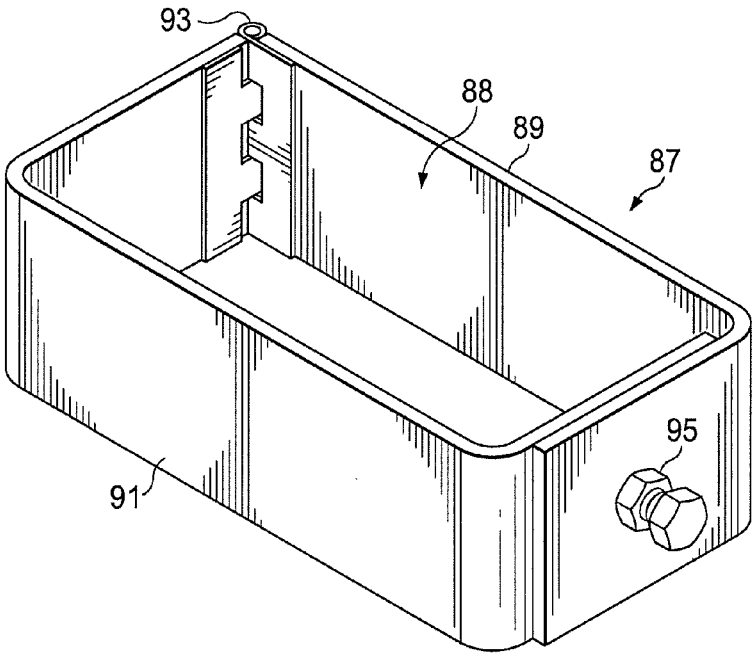
FIG. 8 is an isolated perspective view of one of the hinged brackets of FIG. 7, showing the bracket in the closed position.

FIG. 8 shows one of the specially hinged brackets 87 in the closed condition. The hinged bracket 87 has L-shaped side arms 89, 91 connected by a hinge region 93. The hinge region 93 allows the bracket to pivot between the closed position shown in FIG. 8 and the closed position shown in FIG. 9. When the hinged bracket is closed, as shown in FIG. 8, the internal space 88 which is enclosed by the bracket is approximately sized to receive two of the upright legs (such as the upright legs 83 and 84 in FIG. 7) and to enclose the upright legs.

Figure 9:
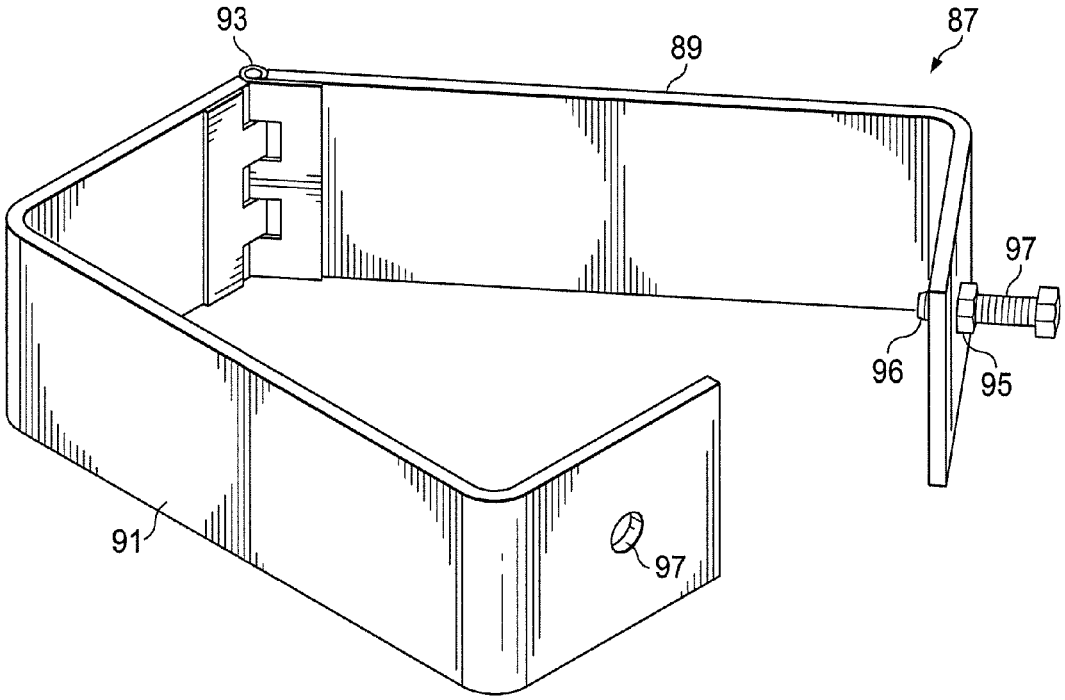
FIG. 9 is another isolated view of the hinged bracket of FIG. 7 showing the bracket in the partially open position.

As best seen in FIG. 9, the right arm 89 has a boss 95 welded on for receiving the shaft of a mating bolt which is received within an internally threaded bore of the boss 95. When the bracket is placed around the upright legs of the enclosure and the left and right arms are closed, the bolt shaft 97 generally aligns with an aperture 97 provided in the left arm 91. The aperture 97 is slightly larger in diameter than the diameter of the bolt shaft 97 to ease assembly.

The hinged brackets are easier to assembly than the U-bolts shown in FIG. 5 in that it is only necessary to place the bracket around the upright legs and then thread the bolt shaft 97 through the threaded boss 95 until the outer extent 96 of the threaded bolt shaft is received in the aperture 97 formed on the left arm 91. It only takes a few turns of the bolt shaft to secure the bracket and, since the bolt shaft is pre-threaded in the boss 95, the bolt can't be dropped. It isn't necessary to hand thread the bolt into the boss at the job site, as this can be done at the factory.

An invention has been provided with several advantages. The protective enclosure of the invention is relatively simple in design and economical to manufacture. It can be manufactured from readily available materials of the type commonly found around oil field operations. The enclosure is extremely sturdy and can withstand impacts of various kinds to protect the enclosed well head equipment. The open nature of the assembly continues to allow workers to access the well head equipment for routine tasks or repairs. Because the enclosure is made up of a series of interlocked panels, it can be easily disassembled and moved to another well site with a minimum of effort.

While the invention has been shown in several of its forms, it is not thus limited and is susceptible to various changes and modifications without departing from the spirit thereof.

I claim:

1. A method protecting an upstanding well head with a protective enclosure located at a well surface location above ground in order to preclude encounter between the well head and objects which might be brought into damaging contact therewith, the method comprising the steps of:

transporting a plurality of structural members from a distant location to the well surface location containing the upstanding well head;

assembling an open framework of structural members to thereby define a quasi-enclosed area adapted to surround and protect the well head, the open framework of structural members being comprised of a plurality of individual steel panels, each of the steel panels being constructed of lengths of square steel tubing, the panels being assembled to form a series of upstanding walls which are covered by a series of roof panels and which together define the quasi-enclosed area surrounding the well head;

covering the series of roof panels with a steel grating which forms a covered roof for the quasi-enclosed area:

wherein the lengths of square steel tubing, when assembled, are spaced to selected distance apart which allows access to the quasi-enclosed area by a worker needing to access the well head;

wherein the individual steel panels which make up the protective enclosure have upright legs which are joined together using hinged brackets;

wherein each of the hinged brackets has an L-shaped left arm which is joined to an L-shaped right arm by a hinged region, the left and right arms of the hinged brackets being pivotable at the hinge region so as to be positionable between an open and closed position, and wherein a selected one of the left and right arms of the hinged brackets are provided with a threaded boss which receives a threaded shaft of a bolt in a threaded bore thereof, the other respective arm being provided with an aperture for receiving an outer extend of the threaded shaft of the bolt when the arms are moved to the closed position;

wherein the aperture is slightly larger in diameter than the diameter of the threaded shaft of the bolt to ease receipt of the threaded shaft within the aperture during assembly;

wherein when the left and right arms are in the closed position, they define an enclosed space which is approximately sized to receive two of the upright legs of two of the steel panels making up the assembly;

wherein the steps of the method include the steps of affixing at least selected ones of the upright legs of the enclosure to surrounding earth by a cemented retaining arrangement;

wherein the steps of using the cemented retaining arrangement include digging a hole in a surface location and burying a planar retaining plate in the hole, the retaining plate having one or more depending retaining legs;

wherein the generally planar retainer plate is buried below the surrounding earth surface and has a top surface arranged generally parallel to the surrounding surface of the earth once cemented in place; and wherein the depending retaining legs of the retaining plate are joined to the selected leg of the enclosure by an upstanding ring member on the plate and a similar upstanding ring member on the enclosure leg, the ring member being joined by a connector element.

2. The method of claim 1, further comprising the steps of:

separating the associated retaining legs of each buried retaining plate from the selected leg of the enclosure by removing the associated connector element;

disassembling the enclosure; and moving the enclosure to another desired location.

* * * * *